US005156189A

United States Patent [19]

Tranovich

[11] Patent Number: 5,156,189

[45] Date of Patent: Oct. 20, 1992

[54] HIGH FLOW CONTROL VALVE

[75] Inventor: Stephen J. Tranovich, Saugus, Calif.

[73] Assignee: HR Textron, Inc., Valencia, Calif.

[21] Appl. No.: 406,949

[22] Filed: Sep. 13, 1989

[51] Int. Cl.[5] ..... F15B 13/043

[52] U.S. Cl. ..... 137/625.68; 137/625.63

[58] Field of Search ..... 137/625.63, 625.68

[56] References Cited

U.S. PATENT DOCUMENTS 3,028,880 4/1962 Reitman ..... 137/625.68 X

*Primary Examiner*—Gerald A. Michalsky

*Attorney, Agent, or Firm*—Nilsson, Robbins, Dalgarn, Berliner, Carson & Wurst

[57] ABSTRACT

A control valve including a second stage spool for controlling flow of fluid from a source thereof to a load. The valve includes one additional pressure slot and one additional return slot on each side thereof and separated by a land on the spool from the usual pressure and return slots respectively. Each of the spool lands separating the pressure and return slots defines and opening therethrough to interconnect the slots so that upon movement of the spool to connect the source to the load, a greater flow of fluid is provided and would be possible with the same size spool without the additional pressure and return slots.

4 Claims, 2 Drawing Sheets

HIGH FLOW CONTROL VALVE

FIELD OF THE INVENTION

This invention relates generally to fluid flow control valves often referred to as servovalves and more particularly to such a valve which provides a higher fluid flow rate than is normally expected for such a valve having a second stage spool valve of a given diameter.

BACKGROUND OF THE INVENTION

In many applications of fluid flow control it is desirable that a relatively large rate of flow of fluid to the load be provided. The flow normally available from a flow control valve utilizing a spool valve as the second stage is limited by the perimeter of the spool, that is, the slot width through which the fluid must flow must be equal to or less than Pi times the spool diameter. Therefore, in the prior art, if such high flow rates are required, the solution has been to increase the diameter of the spool to thereby increase the slot size and thus the fluid flow rate.

Clearly, if such an approach is taken, the size of the control valve is substantially increased and under many applications such cannot be tolerated because of the limitations regarding space and weight.

The best prior art known to applicant are the following United States Letters Patents:

U.S. Pat. No. 2,816,420
U.S. Pat. No. 2,994,345
U.S. Pat. No. 3,070,124
U.S. Pat. No. 3,472,281
U.S. Pat. No. 3,477,472
U.S. Pat. No. 3,556,155
U.S. Pat. No. 3,561,488
U.S. Pat. No. 3,563,272
U.S. Pat. No. 3,580,281
U.S. Pat. No. 4,319,609

SUMMARY OF THE INVENTION

A control valve for applying fluid under pressure from a source to a load and from the load to a return responsive to control signals which includes a spool disposed within a body defining a bore having a plurality of ports interconnected by passageways to the source, the load and the return. The spool is reciprocated responsive to control signals for controlling flow of fluid from the source and the valve includes at least two pressure slots and two return slots connected to the source and return, respectively, each being separated by a land on the spool. Each of the spool lands separating the pressure and return slots defines an opening therethrough to interconnect the slots so that upon movement of the spool to connect the source to the load through the pressure slots, a greater flow of fluid is provided than would be possible with the same size spool valve without the two pressure slots.

DETAILED DESCRIPTION

Figure 1:
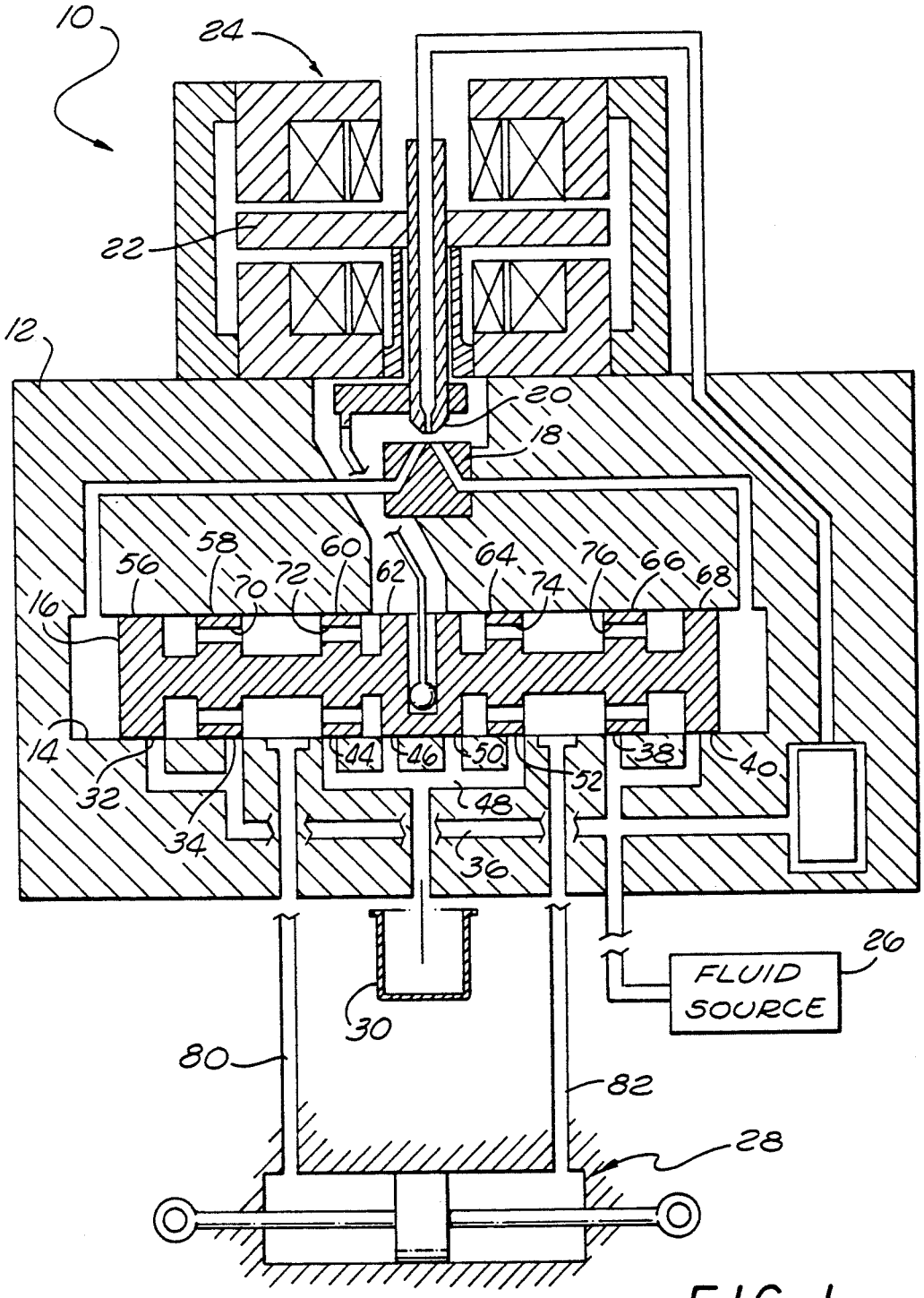
FIG. 1 is a schematic diagram of an electrohydraulic servovalve employing a spool valve constructed in accordance with the principles of the present invention.

As shown in the drawing, there is provided a control valve 10 which includes a body 12 defining a bore 14 within which is disposed a spool 16 for reciprocation in response to control signals applied to opposite ends thereof by flow of fluid through a receiver 18 ejected from a jet pipe 20. The jet pipe 20 is moved by an armature 22 in response to electrical signals applied to a torque motor 24. As the spool 16 reciprocates within the bore 14, it controls the flow of fluid from a source 26 thereof to load 28 which is schematically illustrated as a hydraulic actuator. As fluid flows from the source 26 to the actuator 28 return fluid flows from the actuator 28 to the return 30. The appropriate flow of fluid from the fluid source 26 to the load 28 and from the load 28 to the return 30 is accomplished through appropriate passageways and ports.

All of the foregoing structure is well-known to those skilled in the art and is more fully shown in U.S. Pat. No. 3,584,649 which is incorporated herein by reference. Therefore, no further or detailed description of the apparatus as shown in the figure and thus far generally described is believed necessary to those skilled in the art.

When fluid flow from a source to a load or from the load to return is controlled by a control valve of the type shown in the drawing, the amount of flow is normally controlled and limited by the full perimeter of the spool. As is well-known to those skilled in the art, pressure and return slots are formed in the valve bore and the lands formed on the spool are used to control the flow of fluid from pressure or to return. When one is restricted to a given diameter for the spool and a practical spool stroke, traditionally, such restriction has limited the flow.

In accordance with the principles of the present invention, the bore 14 defines pressure slots 32, 34, 38 and 40 which are connected by appropriate passageways 36 to the source 26. Also provided are return slots 44, 46, 50 and 52 which are connected by appropriate passageways 48 to the return 30.

As is well known to those skilled in the art, the pressure and return slots are normally formed within a sleeve which is fitted within the bore 14 and which sleeve in turn receives the spool 16. However, for ease of illustration and description the sleeve has not been shown. The spool 16 includes a plurality of lands 56, 58, 60, 62, 64, 66 and 68. The lands 56 and 58 meter the flow of fluid through pressure slots 32 and 34 respectively. The lands 66 and 68 meter the flow of fluid through the pressure slots 38 and 40 respectively. Lands 60 and 62 meter the flow of fluid through return slots 44 and 46 respectively while lands 62 and 64 meter the flow of fluid through return slots 50 and 52 respectively.

Each of the lands 58, 60, 64 and 66 is provided with a passageway 70, 72, 74 and 76, respectively, which runs parallel to the axis of the spool 16. As can be seen, the passageway 70 interconnects pressure slots 32 and 34 when the spool 16 is moved toward the left while passageway 76 interconnects the pressure slots 38 and 46 when the spool 16 is moved toward the right as viewed in FIG. 1. Similarly, the passageway 72 interconnects the return slots 44 and 46 when the spool 16 is moved toward the right and the passageway 74 interconnects the return slots 50 and 52 when the spool 16 is moved toward the left as viewed in FIG. 1. By thus interconnecting the duplicate pressure and return slots with the spool axial passageways, there is provided an effective spool diameter approximately double that normally anticipated with a spool of a given size. As a result, for example with respect to fluid from the source 26, if the spool 16 has moved toward the left as viewed in the figure thus supplying fluid under pressure by way of the passageway 80 to the load 28, an increased flow is provided through the slot 32 and the passageway 72, which sums with the slot 34 and thus into the passageway 80 to the load 28. At the same time fluid flows from the load 28 through the conduit 82 through the slot 52 and the opening 74 and the slot 50 to return 30. It will be recognized by those skilled in the art, both with respect to flow from the source to the load and from the load to return, that there is provided an increased rate of flow of the fluid by way of provision of the extra slot at both the pressure and return flow areas along with the interconnecting passageway or opening in the spool. As a result, by the addition of the extra slot and land and interconnecting passageway, a greater flow handling capability is provided for a spool valve of a given restricted diameter. Obviously, the additional pressure and return slots function in precisely the same manner as above-described when the spool is caused to move toward the right with the summed pressure flow to the load through passageway 82 and return through passageway 80. As a result, the actuator may reciprocate in accordance with any desired input signals to the torque motor 24 in accordance with any application to provide increased hydraulic fluid flow from the source to either side of the actuator and from either side of the actuator to return as may be required.

Figure 2:
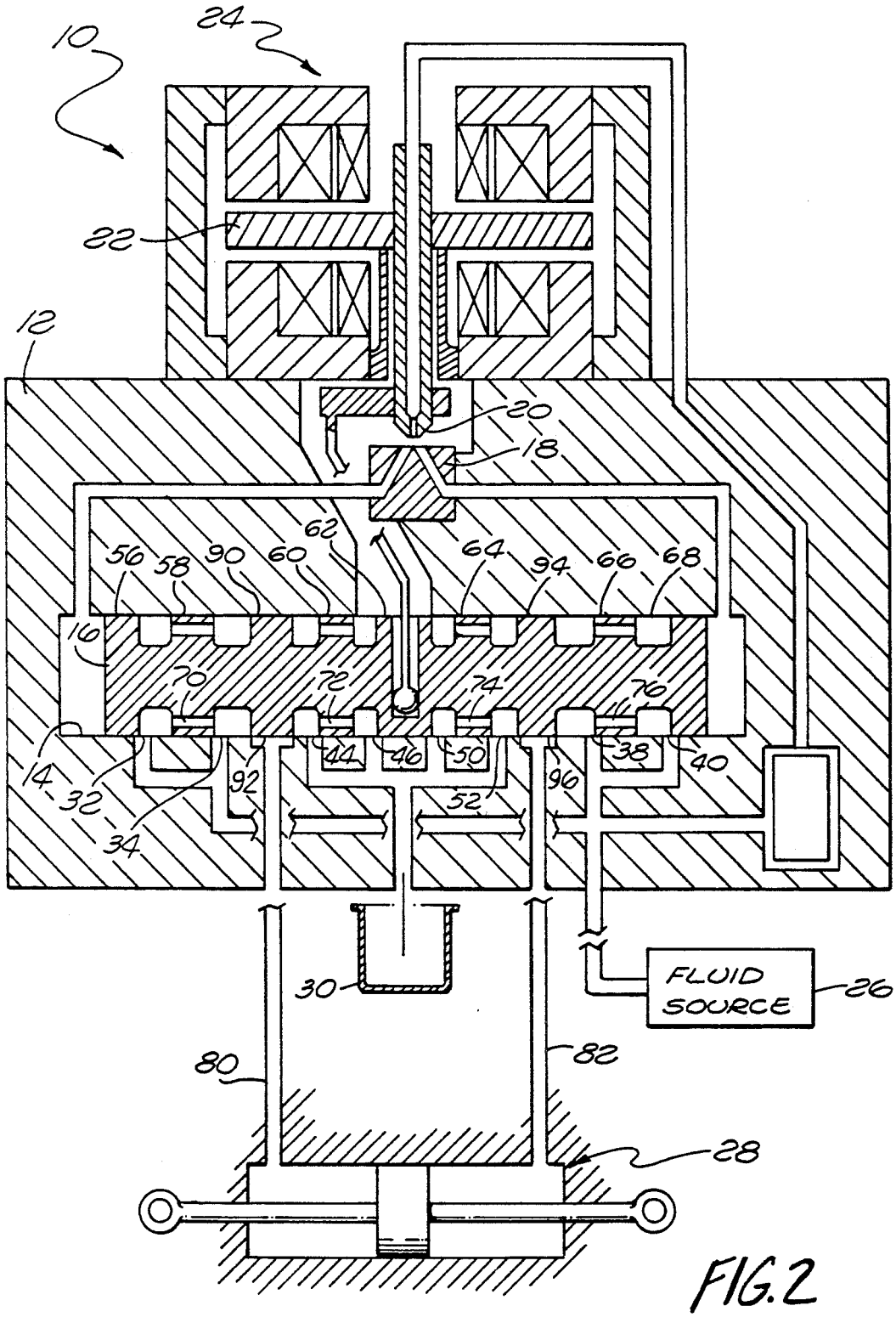
FIG. 2 is a similar schematic diagram showing a specific application of the present invention to a high flow fail-fixed spool.

There is illustrated in FIG. 2, to which reference is hereby made, an application the high flow spool to a fail-fixed servovalve. That is, when the spool exceeds its normal operating stroke the parts leading to the actuator are blocked. The construction shown also provides high gain when the spool is transitioning into the fail-fixed mode. Similar elements shown in FIG. 2 to those shown in FIG. 1 use common numbers for ease of description.

In accordance with the principles of the present application of the present invention, the spool 16 is provided with pressure slots 72 and 74 separated by a land 76 and with pressure slots 78 and 80 separated by a land 82. Also provided are return slots 84 and 86 separated by a land 88 as well as return slots 90 and 92 separated by a land 94. Each of the lands 76, 82, 88, and 94 is provided with a passageway 96, 98, 100 and 102, respectively, which runs parallel to the axis of the spool 16 and interconnects with slots which it separates. An additional land 104 meters the flow of fluid through the passageway 66 while the additional land 106 meters the flow of fluid through the passageway 68. As a result, for example with respect to fluid from the source 26, if the control valve 16 has moved toward the right as viewed in the figure thus supplying fluid under pressure by way of the passageway 62 to the load 28, an increased flow is provided through the slot 72 and the opening 96 into the slot 74 and thus into the passageway 66 to the load 28. At the same time fluid flows from the load 28 through the conduit 68 through the slot 92 and the opening 102 and the slot 90 to return 30. It will be recognized by those skilled in the art, both with respect to flow from the source to the load and from the load to return, that the valves shown in FIG. 2 functions to provide the increased flow while retaining a small diameter spool as discussed above with respect to FIG. 1. Furthermore, it will also be evident that a high gain on transition to the fail-fixed mode is achieved.

There has thus been disclosed a control valve providing increased flow for a spool valve of a predetermined diameter over that which would normally be available without significant increase in size and weight.

By reference now to FIG. 4, there is illustrated an application of the high flow valve to a fail-fixed servo valve. That is, when the spool exceeds its normal operating stroke, the ports leading to the actuator are blocked. The construction shown also provides high flow versus stroke gain when the spool is transitioning into the fail-fixed mode. Those elements of the valve as illustrated in FIG. 2 which are similar to those illustrated in FIG. 1 use common numbers for ease of description.

The basic distinction between the structure as illustrated in FIG. 2 and that as illustrated in FIGURE 1 is the utilization of an additional land for purposes of metering the flow of fluid through the valve to the load 28. As is shown, a land 90 is used to meter flow through the cylinder slot 92 while a land 94 is used to meter flow through the cylinder slot 96. It will also be noted by those skilled in the art that the pressure slots 32, 34, 38 and 40 as well as the return slots 44, 46, 50, and 52 are not metered by lands of the spool 16 as was the case with respect to FIG. 1. It will, however, be noted that the pressure slots 32 and 34 and interconnected by the passageway 70 in the spool 16 while the pressure slots 38 and 40 are interconnected by the passageway 76. Similarly, the return slots 44 and 46 are interconnected by the passageway 72 while the return slots 50 and 52 are interconnected by the passageway 74.

It will be recognized by those skilled in the art that when the valve is illustrated in FIG. 2 is in the position as is therein shown, no flow of fluid to or from the load 28 occurs since the lands 90 and 94 are blocking the cylinder slot 92 and 96 respectively. However, if the spool 16 were to move toward the right as viewed in FIG. 2, the land 90 would open the cylinder slot 92 thus permitting the flow of fluid from the source 26 through the pressure slots 32 and 34 interconnected by the passageway 70 and through the passageway 80 to the load 28. Also, fluid would return through the passageway 82 and through the return slots 50 and 52 interconnected by the passageway 74 to return. If the spool 16 continued to move toward the right, the pressure slots 32 and 34 would be closed by the lands 56 and 58 respectively thus, blocking flow of fluid through the cylinder slot 92. In a similar fashion, the lands 62 and 64 would respectively block the return slots 50 and 52. As a result of the utilization of the interconnected pressure slots 32 and 34, a substantially greater flow capability is provided to the valve as illustrated in FIG. 2 during the period of time when it is transitioning from its operational state to its fail-fixed mode. As a result, there would be provided a greater rate of change of flow with respect to spool position than would otherwise be possible with a spool of the same diameter. As a result, the valve as illustrated in FIG. 2 provides a high flow high gain on transition to the fail-fixed mode.

Obviously, if the spool 16 is moved toward the left as viewed in FIG. 2, the flow from the pressure source to the load 28 is through the pressure slots 38 and 40 interconnected by he passageway 76 and thence through the passageway 82 while return flow is through the passageway 80 and the return slots 44 and 46 interconnected by the passageway 72 and thence to return 30.

The same high gain on transition to the fail-fixed mode is achieved when the spool is translated in this direction in the same manner as was discussed above.

What is claimed is:

1. A control valve for applying fluid under pressure from a source thereof to a load and from said load to return responsive to control signals comprising:

a body defining a bore therein;

a plurality of ports in said bore;

passageways connecting said source, load and return to selected ones of said ports;

a spool having a plurality of lands disposed within said bore for reciprocal movement responsive to said control signals for controlling said fluid;

at least two pressure slots defined by said bore, each of said pressure slots being independently connected to said source;

a first land on said spool disposed between said pressure slots and having an opening therethrough to interconnect said pressure slots during the time fluid is flowing from said source to said load through said pressure slots;

at least two return slots defined by said bore, each of said return slots being connected independently to said return;

a second land on said spool disposed between said return slots and having an opening therethrough to interconnect said return slots during the time fluid is flowing form said load to said return through said return slots;

whereby upon movement of said spool to connect said source to said load through said pressure slots a greater flow of fluid is provided than would be possible with the same size valve without said at least two pressure slots.

2. A control valve as defined in claim 1 wherein said spool lands meter flow of fluid through said pressure and return slots.

3. A control valve as defined in claim 1 wherein said spool valve includes four return slots and four pressure slots, said four return slots being interposed between pairs of said pressure slots, adjacent ones of said slots being separated by a land on said spool valve, a first pair of said pressure slots and a first pair of said return slots being operatively associated with a first port while a second pair of said pressure slots and a second pair of said return slots being operatively associated with a second port.

4. A control valve as defined in claim 3 which further includes two additional lands respectively metering flow to and from said load and wherein flow to said load is blocked upon said spool exceeding its normal operational stroke.

* * * * *